US007636967B1

(12) United States Patent
Stokes

(10) Patent No.: US 7,636,967 B1
(45) Date of Patent: Dec. 29, 2009

(54) MASSAGE TABLE ASSEMBLY

(76) Inventor: Ellen M. Stokes, 11667 E. Tierney Creek, Las Vegas, NV (US) 89183

( * ) Notice: Subject to any disclaimer, the term of this patent is extended or adjusted under 35 U.S.C. 154(b) by 0 days.

(21) Appl. No.: 12/200,216

(22) Filed: Aug. 28, 2008

(51) Int. Cl.
*A61G 13/00* (2006.01)
*A61G 13/12* (2006.01)

(52) U.S. Cl. ..... 5/620; 5/622; 5/623; 5/725; 5/735

(58) Field of Classification Search ..... 5/620, 5/622, 623, 725, 735
See application file for complete search history.

(56) References Cited

U.S. PATENT DOCUMENTS

| | | | | |
|---|---|---|---|---|
| 3,165,630 | A * | 1/1965 | Bielat et al. | 378/37 |
| 4,596,384 | A * | 6/1986 | Blosser | 5/613 |
| 4,973,034 | A | 11/1990 | Michele | |
| 5,078,142 | A * | 1/1992 | Siczek et al. | 600/407 |
| 5,237,712 | A | 8/1993 | Ramsay | |
| D392,145 | S | 3/1998 | Thurston | |
| D403,772 | S | 1/1999 | Fanuzzi | |
| 6,049,926 | A | 4/2000 | Amaral | |
| 6,081,947 | A | 7/2000 | Disher | |
| 6,419,390 | B1 * | 7/2002 | Landis-Lowell | 378/209 |
| 6,934,988 | B1 | 8/2005 | Wetzler | |
| 6,938,287 | B1 * | 9/2005 | Mahshie | 5/111 |
| 7,127,764 | B1 | 10/2006 | Harding et al. | |
| 7,194,778 | B2 | 3/2007 | Riach | |
| 7,254,851 | B2 * | 8/2007 | Salit et al. | 5/601 |
| 2006/0112490 | A1 | 6/2006 | Chausse | |
| 2007/0251010 | A1 * | 11/2007 | Lara | 5/620 |

* cited by examiner

*Primary Examiner*—Alexander Grosz

(57) ABSTRACT

A massage table assembly includes a tabletop has a top side, a bottom side, a first end, a second end, a first lateral edge and a second lateral edge. The tabletop has a pair of breast openings therein configured to receive breasts of a person lying face down on the tabletop. The openings are aligned with each other along a line oriented perpendicular to the first lateral edge and are positioned nearer to the first end than the second end. A plurality of legs is attached to and extends downwardly from the bottom side. A guide is attached to the bottom side of the tabletop nearer to the first end than the second end. A container is removably positioned on the guide and is aligned with the openings when container is placed on the guide to cover breasts extending through the tabletop.

7 Claims, 8 Drawing Sheets

MASSAGE TABLE ASSEMBLY

BACKGROUND OF THE INVENTION

Field of the Invention

The present invention relates to massage table devices and more particularly pertains to a new massage table device for providing access openings for a woman's breasts during a massage.

SUMMARY OF THE INVENTION

The present invention meets the needs presented above by generally comprising a tabletop has a top side, a bottom side, a first end, a second end, a first lateral edge and a second lateral edge. The tabletop has a pair of breast openings therein configured to receive breasts of a person lying face down on the tabletop. The openings extend into the top side and outwardly through the bottom side. The openings are aligned with each other along a line oriented perpendicular to the first lateral edge and are positioned nearer to the first end than the second end. A plurality of legs is attached to and extends downwardly from the bottom side. A guide is attached to the bottom side of the tabletop nearer to the first end than the second end. A container is removably positioned on the guide and is aligned with the openings when container is placed on the guide to cover breasts extending through the tabletop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
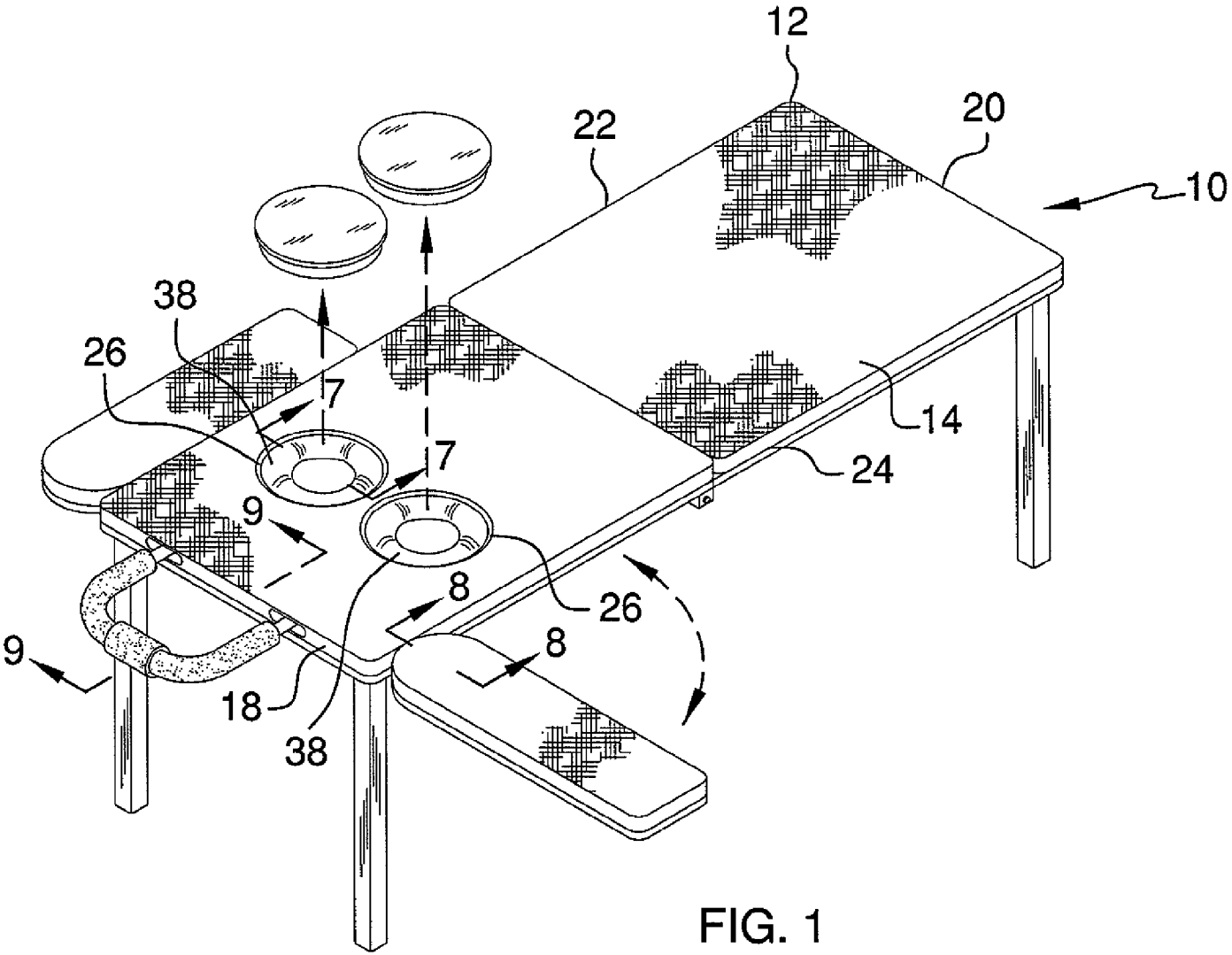
FIG. 1 is an expanded top perspective view of a massage table assembly according to the present invention.
Figure 2:
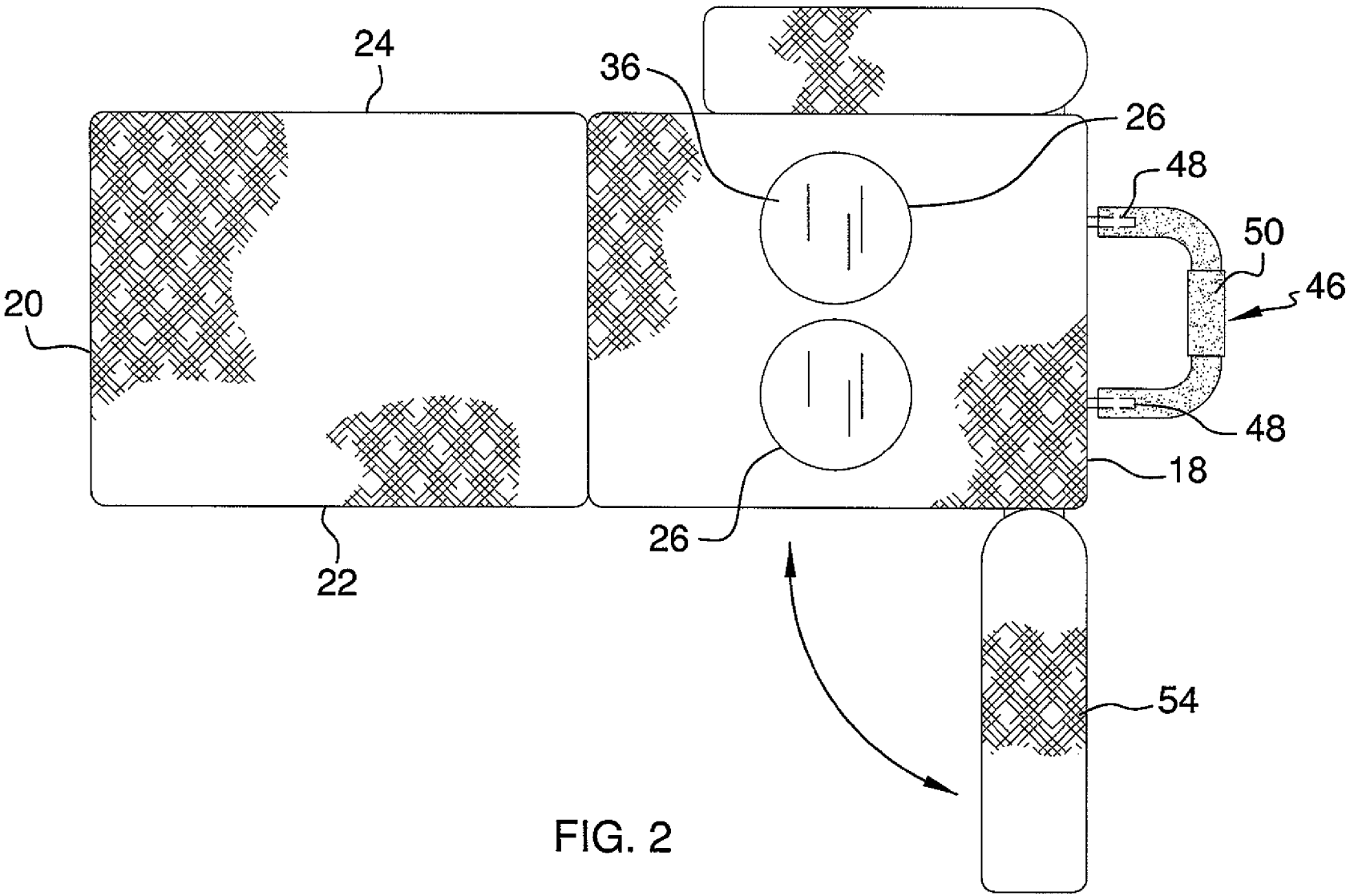
FIG. 2 is a top view of the present invention.
Figure 3:
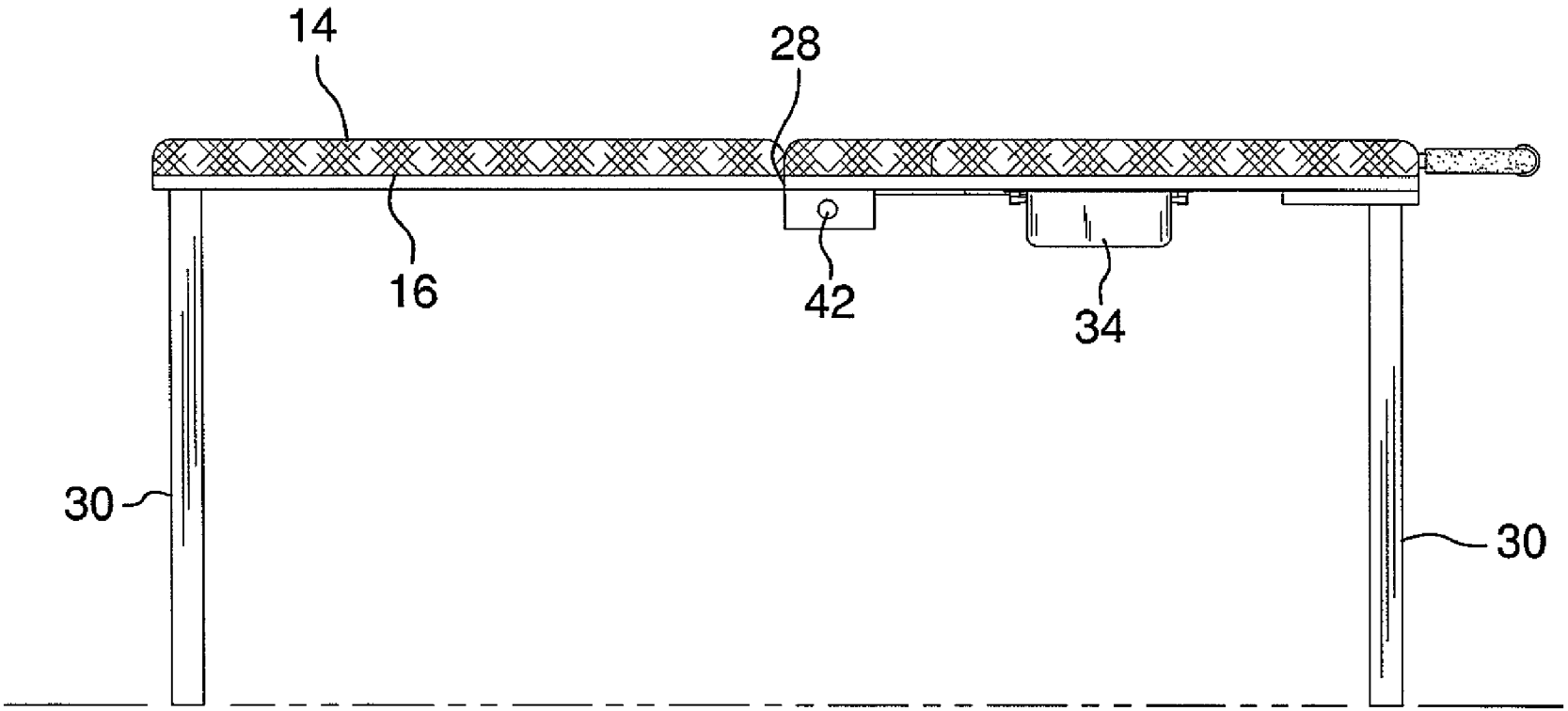
FIG. 3 is a right side view of the present invention.
Figure 4:
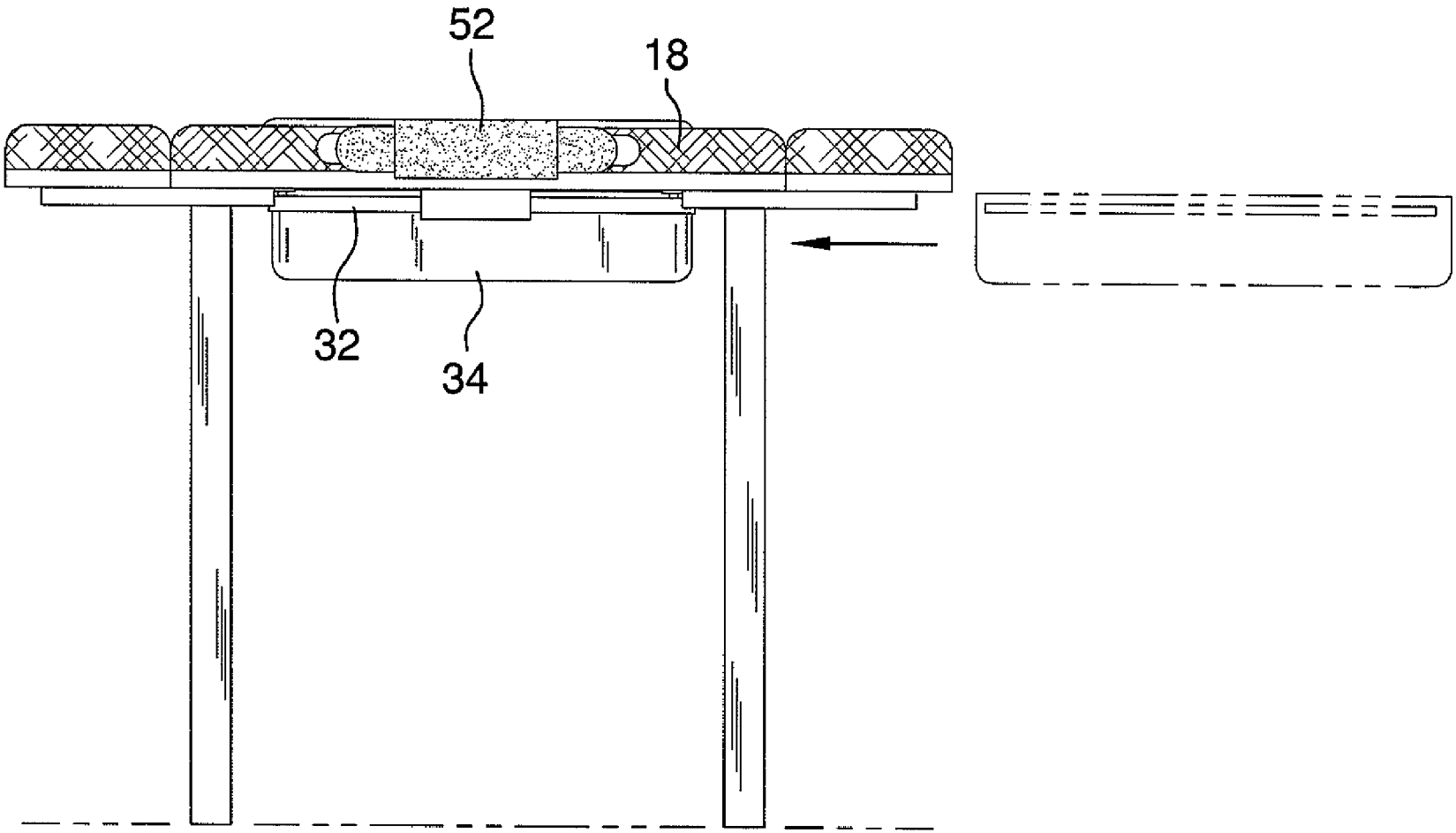
FIG. 4 is an end view of the present invention.
Figure 5:
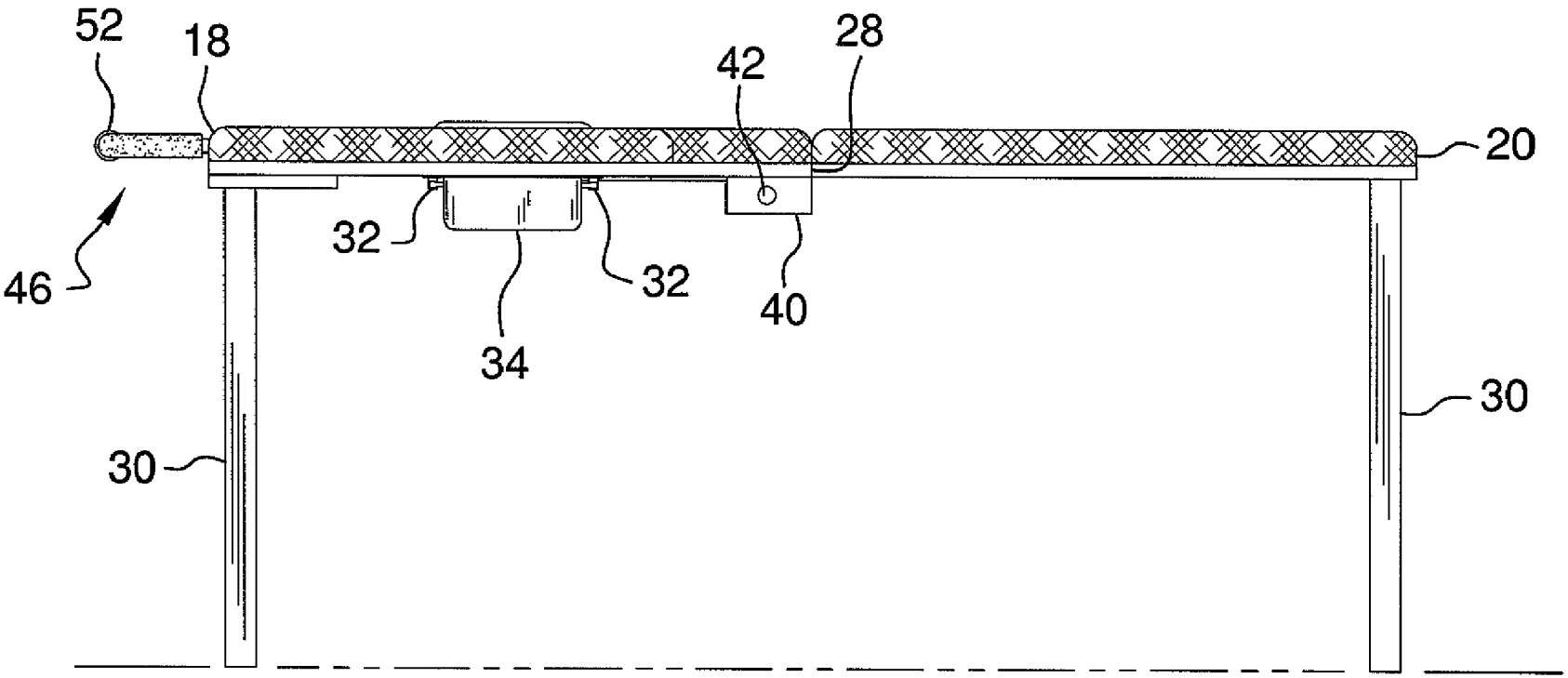
FIG. 5 is a left side view of the present invention.
Figure 6:
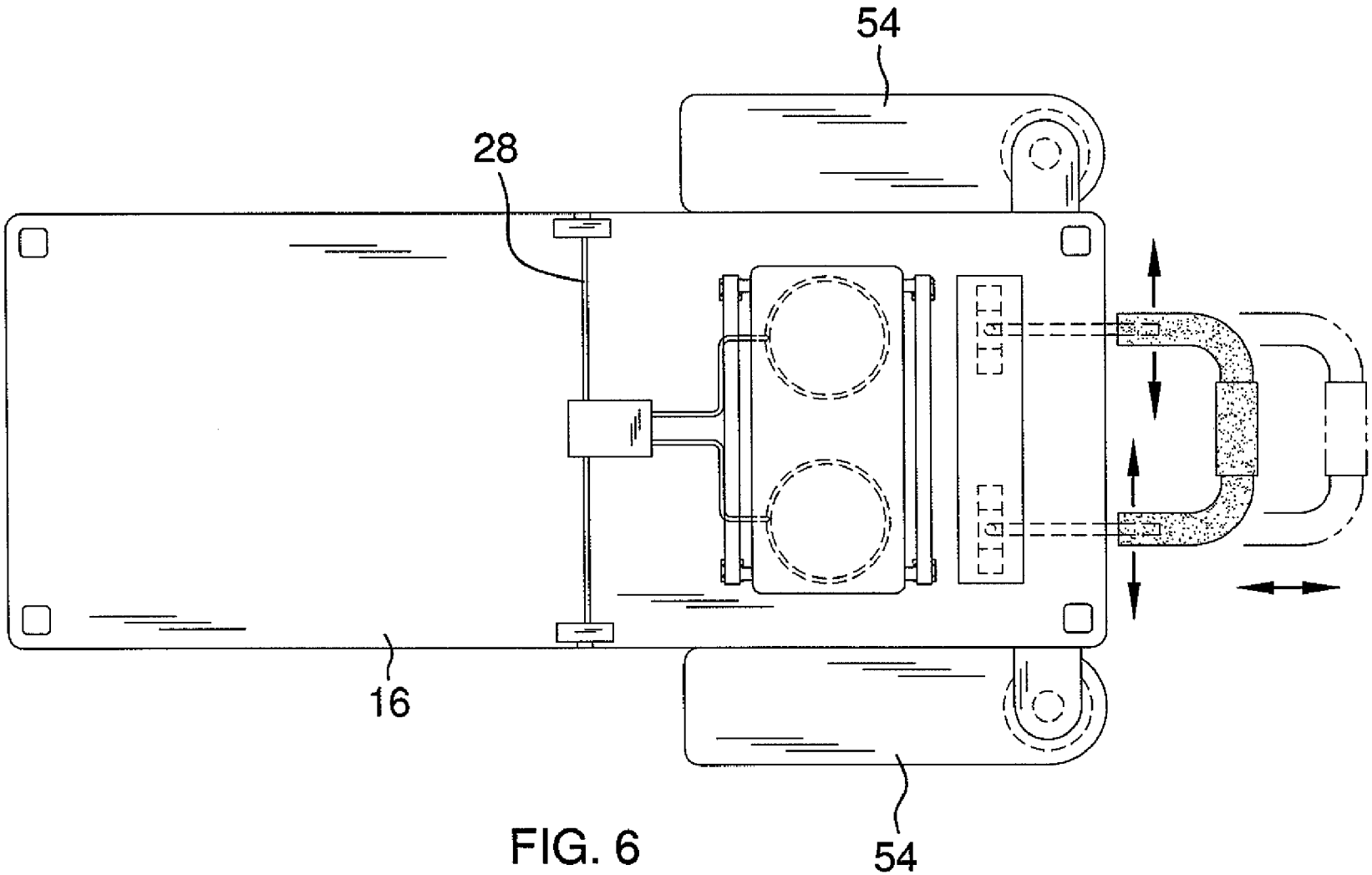
FIG. 6 is a bottom view of the present invention.
Figure 10:
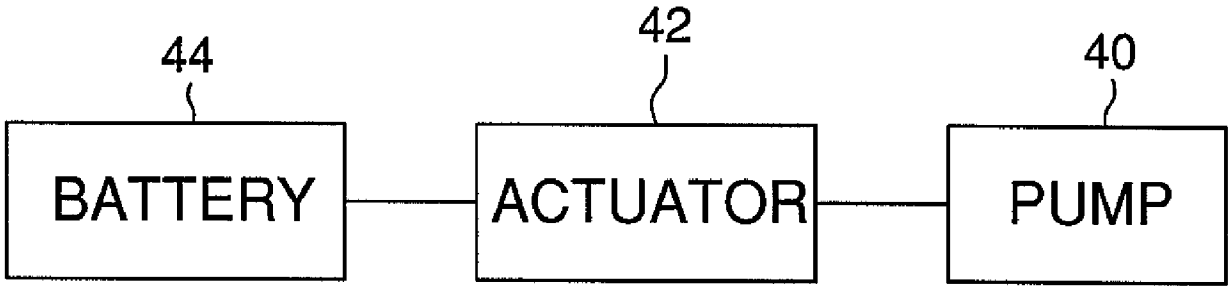
FIG. 10 is a schematic view of the present invention.
Figure 7B:
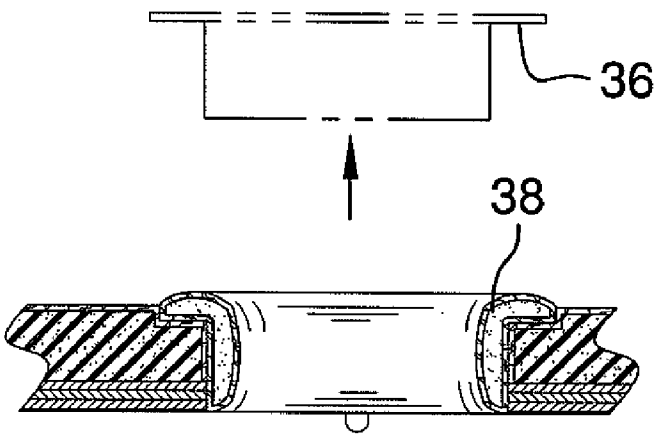
FIG. 7B is a cross-sectional view of the present invention taken along line 7-7 of FIG. 1 showing the insert removed and a bladder inflated.
Figure 7A:
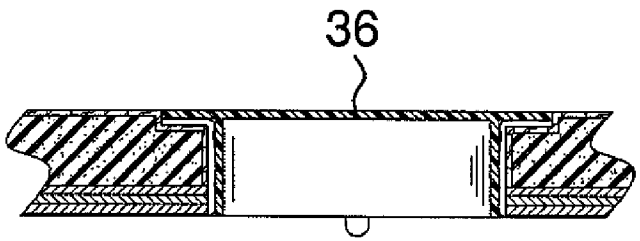
FIG. 7A is a cross-sectional view of the present invention taken along line 7-7 of FIG. 1 showing an insert in place.
Figure 8:
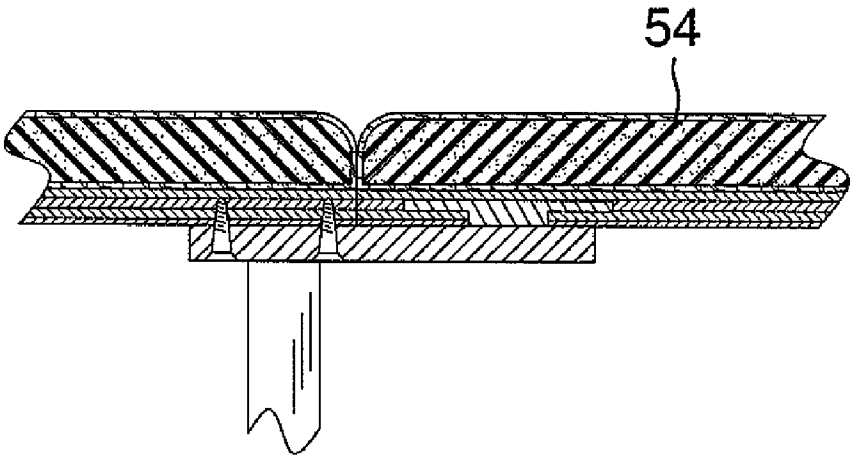
FIG. 8 is a cross-sectional view taken along line 8-8 of FIG. 1 of the present invention.
Figure 9:
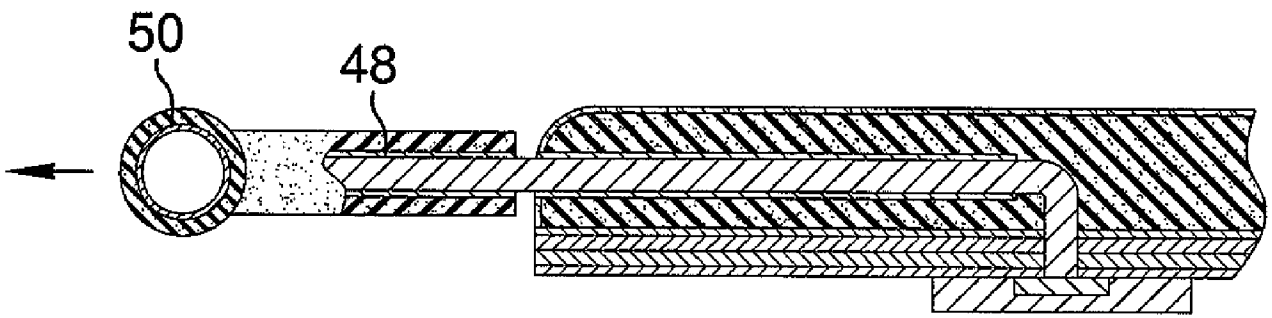
FIG. 9 is a cross-sectional view taken along line 9-9 of FIG. 1 of the present invention.

With reference now to the drawings, and in particular to FIGS. 1 through 10 thereof, a new massage table device embodying the principles and concepts of the present invention and generally designated by the reference numeral 10 will be described.

As best illustrated in FIGS. 1 through 10, the massage table assembly 10 generally comprises a tabletop 12 that has a top side 14, a bottom side 16, a first end 18, a second end 20, a first lateral edge 22 and a second lateral edge 24. The tabletop 12 has a pair of breast openings 26 therein configured to receive breasts of a person lying face down on the tabletop 12. The openings 26 are circular shaped and have a diameter between 5 inches and 10 inches. The openings 26 extend into the top side 14 and outwardly through the bottom side 16 and are aligned with each other along a line oriented perpendicular to the first lateral edge 22. The openings 26 are positioned nearer to the first end 18 than the second end 20. The tabletop 12 has a break 28 therein between the first 18 and second 20 ends to allow the tabletop 12 to be folded. A plurality of legs 30 is attached to and extends downwardly from the bottom side 16.

A guide 32 is attached to the bottom side 16 of the tabletop 12 nearer to the first end 18 than the second end 20. A container 34 is removably positioned on the guide 32 and is aligned with the openings 26 when container is placed on the guide 32 to cover breasts extending through the tabletop 12.

A pair of inserts 36 is provided. Each of the inserts 36 is removably positioned in one of the openings 26 to form a flush surface over the openings 26 with respect to an area adjacent to the openings 26. The inserts 34 are used when the openings 26 are not required, such as for a man or if the woman is lying on her back.

A pair of donut shaped bladders 38 is also provided. Each of the bladders 38 is attached to and extends around a perimeter edge of one of the openings 26. An air pump 40 is fluidly coupled to each of the bladders 38. The air pump 40 injects air into the bladders 38 when the air pump 40 is turned on to decrease a diameter of the openings 26 and to provide cushioning of the openings 26. The bladders 40 may extend upwardly over a plane of the top side 14 when filled with air. An actuator 42 is electrically coupled to the air pump 40 to turn the air pump on or off. A power source, such as a battery 44, is electrically coupled to the air pump 40 to supply power to the air pump 40.

A head support 46 is attached to and extends away from the first end 18 of the tabletop 12. The head support 46 is U-shaped and includes a pair of arms 48 and a central member 50 that is attached to and extends between the arms. The arms 48 are attached to the first end 18 and are spaced from each other a distance greater than 7 inches to prevent a face of a person lying on the table from contacting the arms 48 when a forehead of the person is resting on the central member 50. The arms 48 are slidably mounted in the tabletop 12 to allow adjusting of a distance between the central member 50 and the first end 18. A cushioning member 52 is positioned on the central member.

A pair of arm supports 54 is attached to the tabletop 12. Each of the first 22 and second 24 lateral edges has one of the arm supports 54 attached thereto. The arm supports 54 are pivotally coupled to the tabletop 12 and pivotable laterally from a corresponding one of the first 22 and second 24 lateral edges. The arm supports 54 remain coplanar with the tabletop 12 as the arm supports 54 are pivoted with respect to the tabletop 12.

In use, the tabletop 12 is used in a conventional manner to provide massages, however, the openings 26 in the tabletop 12 provide more comfort for a woman since the breasts will not by laid on during the massage. The bladders 38 provide support and cushioning for the breasts.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A massage table assembly comprising:

a tabletop having a top side, a bottom side, a first end, a second end, a first lateral edge and a second lateral edge, said tabletop having a pair of breast openings therein configured to receive breasts of a person lying face down on said tabletop, said openings extending into said top side and outwardly through said bottom side, said openings being aligned with each other along a line oriented perpendicular to said first lateral edge and being positioned nearer to said first end than said second end;

a plurality of legs being attached to and extending downwardly from said bottom side;

a guide being attached to said bottom side of said tabletop nearer to said first end than said second end; and a container being removably positioned on said guide and being aligned with said openings when the container is placed on said guide to cover breasts extending through said tabletop.

2. The assembly according to claim 1, further including a pair of inserts, each of said inserts being removably positioned in one of said openings to form a flush surface over said openings with respect to an area adjacent to said openings.

3. The assembly according to claim 1, further including:

a pair of donut shaped bladders, each of said bladders being attached to and extending around a perimeter edge of one of said openings; and an air pump being fluidly coupled to each of said bladders, said air pump injecting air into said bladders when said air pump is turned on to decrease a diameter of said openings and to provide cushioning of said openings.

4. The assembly according to claim 3, further including a head support being attached to and extending away from said first end of said tabletop, said head support being U-shaped and including a pair of arms and a central member being attached to and extending between said arms, said arms being attached to said first end, said arms being spaced from each other a distance greater than 7 inches to prevent a face of a person lying on said table from contacting the arms when a forehead of the person is resting on said central member, a cushioning member being positioned on said central member.

5. The assembly according to claim 1, further including a head support being attached to and extending away from said first end of said tabletop, said head support being U-shaped and including a pair of arms and a central member being attached to and extending between said arms, said arms being attached to said first end, said arms being spaced from each other a distance greater than 7 inches to prevent a face of a person lying on said table from contacting the arms when a forehead of the person is resting on said central member, a cushioning member being positioned on said central member.

6. The assembly according to claim 1, further including a pair of arm supports being attached to said tabletop, each of said first and second lateral edges having one of said arm supports attached thereto, said arm supports being pivotally coupled to said tabletop and pivotable laterally from a corresponding one of said first and second lateral edges, said arm supports remaining coplanar with said tabletop as said arm supports are pivoted with respect to said tabletop.

7. A massage table assembly comprising:

a tabletop having a top side, a bottom side, a first end, a second end, a first lateral edge and a second lateral edge, said tabletop having a pair of breast openings therein configured to receive breasts of a person lying face down on said tabletop, said openings extending into said top side and outwardly through said bottom side, said openings being aligned with each other along a line oriented perpendicular to said first lateral edge and being positioned nearer to said first end than said second end, said tabletop having a break therein between said first and second ends to allow said tabletop to be folded;

a plurality of legs being attached to and extending downwardly from said bottom side;

a guide being attached to said bottom side of said tabletop nearer to said first end than said second end;

a container being removably positioned on said guide and being aligned with said openings when the container is placed on said guide to cover breasts extending through said tabletop;

a pair of inserts, each of said inserts being removably positioned in one of said openings to form a flush surface over said openings with respect to an area adjacent to said openings;

a pair of donut shaped bladders, each of said bladders being attached to and extending around a perimeter edge of one of said openings;

an air pump being fluidly coupled to each of said bladders, said air pump injecting air into said bladders when said air pump is turned on to decrease a diameter of said openings and to provide cushioning of said openings;

a head support being attached to and extending away from said first end of said tabletop, said head support being U-shaped and including a pair of arms and a central member being attached to and extending between said arms, said arms being attached to said first end, said arms being spaced from each other a distance greater than 7 inches to prevent a face of a person lying on said table from contacting the arms when a forehead of the person is resting on said central member, a cushioning member being positioned on said central member; and a pair of arm supports being attached to said tabletop, each of said first and second lateral edges having one of said arm supports attached thereto, said arm supports being pivotally coupled to said tabletop and pivotable laterally from a corresponding one of said first and second lateral edges, said arm supports remaining coplanar with said tabletop as said arm supports are pivoted with respect to said tabletop.

* * * * *